US007522116B2

(12) United States Patent
Balling et al.

(10) Patent No.: US 7,522,116 B2
(45) Date of Patent: Apr. 21, 2009

(54) MULTIBEAM ANTENNA

(75) Inventors: Peter Balling, Taastrup (DK); Cyril Mangenot, Wassenaar (NL); Antoine Roederer, Noordwijk (NL)

(73) Assignee: Agence Spatiale Europeenne, Paris Cedex (FR)

( * ) Notice: Subject to any disclaimer, the term of this patent is extended or adjusted under 35 U.S.C. 154(b) by 0 days.

(21) Appl. No.: 11/707,035

(22) Filed: Feb. 16, 2007

(65) Prior Publication Data

US 2007/0195000 A1 Aug. 23, 2007

(30) Foreign Application Priority Data

Feb. 23, 2006 (FR) ..... 06 01585

(51) Int. Cl.
*H01Q 13/00* (2006.01)

(52) U.S. Cl. ..... 343/779; 343/781 P; 343/840; 343/755

(58) Field of Classification Search ..... 343/779, 343/781 P, 837, 840, 755
See application file for complete search history.

(56) References Cited

U.S. PATENT DOCUMENTS 2,835,891 A * 5/1958 Peeler et al. ..... 343/754
3,235,870 A * 2/1966 Hannan ..... 343/756
3,271,771 A * 9/1966 Hannan et al. ..... 343/756
3,821,746 A * 6/1974 Betsudan et al. ..... 343/781 R
4,145,695 A * 3/1979 Gans ..... 343/779
6,243,051 B1 6/2001 Vanstrum et al.
6,424,310 B1 * 7/2002 Broas et al. ..... 343/781 P

FOREIGN PATENT DOCUMENTS

EP 1 643 590 4/2006

OTHER PUBLICATIONS

K. Hariu et al., "Pattern Correction in Large Deployable Reflector Antennas with Phased Array Feed", Antennas and Propagation Society International Symposium, Jul. 13, 1997, IEEE, vol. 2, pp. 844-847.

S. Stirland et al., "Trends in Multi-Beam Reflector Antennas for Space", published Apr. 13, 2000 (Millennium Conference on Antennas and Propagation—AP2000).

(Continued)

*Primary Examiner*—Tho G Phan
(74) *Attorney, Agent, or Firm*—Clark & Brody

(57) ABSTRACT

An antenna capable of generating multiple beams that are close together and have side lobes of low level includes optics comprising a single main reflector and a set of primary sources, each source suitable for generating a beam taken up by the optics that transmits it, or suitable for receiving a beam picked up by the optics of the antenna. The main reflector has an aperture of diameter D as a function of the center wavelength of the frequency band of the beams and the half-power beam width of the beams coming from the main antenna element, and a dimensionless number lying in the range 1.5 to 4. The optics present a profile that is modified relative to conventional optics comprising a parabolic main reflector by a correction that imparts an amplitude and phase distribution that is preferably circularly symmetrical, and compliant with a relationship for enlarging the reflected beams.

17 Claims, 5 Drawing Sheets

OTHER PUBLICATIONS

R. Jorgensen et al., "Dual Offset Reflector Multibeam Antenna for International Communications Satellite Applications", IEEE, Transactions on Antennas and Propagation, vol. AP-33, No. 12, Dec. 1985, pp. 1304-1312.

G. Doro et al., "A 20/30 GHz Multibeam Antenna for European Coverage", IEEE 1982-APS Symposium, pp. 342-345.

W. H. Press et al., "Numerical Recipes in FORTRAN, The Art of Scientific Computing", Cambridge University Press, Second Edition, vol. 1, 1992, pp. 402-406.

D. M. Pozar, "A Shaped-Beam Microstrip Patch Reflectarray", IEEE Transactions on Antennas and Propagation, vol. 47, No. 7, Jul. 1999, pp. 1167-1173.

* cited by examiner

FIG.2b
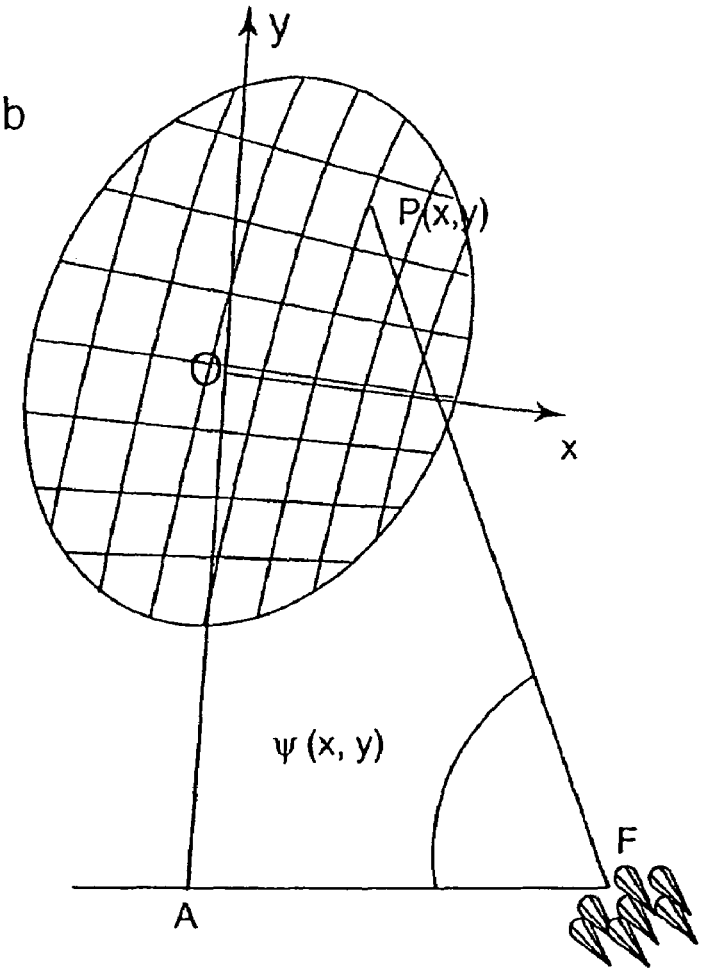
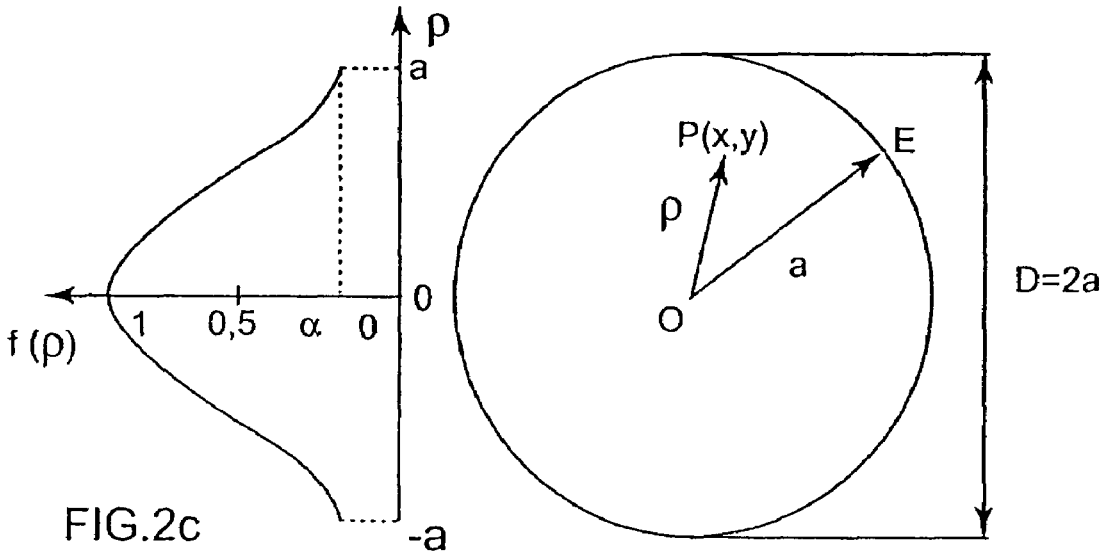
FIG.2c

MULTIBEAM ANTENNA

The present invention provides a multibeam antenna for telecommunications, in particular by satellite, and more particularly it relates to a transmitter or receiver antenna presenting a plurality of close-together beams with side lobes of low level, so as to reduce interference between the various beams that might reuse the same frequencies.

BACKGROUND OF THE INVENTION

There are three types of antenna configuration presently in use for generating multiple beams that are close together with a high degree of overlap and with side lobes of low level.

A first type of antenna is of the array type with direct radiation, and it uses beam-forming networks that are very complex and that feed a very large number (hundreds or thousands) of radiating sources, each of which is fed by a respective amplifier.

A second known type of antenna uses a parabolic reflector (one for transmission and one for reception) in which each beam is generated by a cluster of 7, 12, or 19 primary sources, the clusters allocated to adjacent beams being caused to overlap by sharing some of the primary sources. The signals that feed the shared individual sources are distributed in transmission and/or grouped together in reception.

The transmission antenna presents a complex beam-forming network suitable for combining a plurality of signals in the primary sources, most of which are shared between adjacent beams.

In receive mode, each element is coupled to a low-noise amplifier and the network is likewise complex.

An antenna of this type using clusters of seven primary sources and operating in the 18.1 gigahertz (GHz)–20.2 GHz band with frequency re-utilization and 108 beams is described in the article by G. Doro et al. entitled "A 20/30 GHz multibeam antenna for European coverage", published in IEEE—APS Symposium, 1982, pp. 342 to 345.

A third type of antenna avoids this complexity concerning signal generation and the number of primary sources by allocating a single primary source to each beam (so there are thus as many primary sources as there are beams), however that implies no longer using only one parabolic reflector, but instead using three or four parabolic reflectors, each of which generates a plurality of beams. The aperture or diameter $D_0$ of the parabolic reflectors is of the order of 70 λ/HPBW, where λ is the mean wavelength of the band in which the beams are transmitted (or received) by the antenna, and HPBW is the half-power beam width expressed as an aperture angle in degrees, $D_0$ and λ being expressed in the same units. For example $D_0$ may lie in the range 60 centimeters (cm) to 80 cm.

The beams transmitted by the various reflectors are interlaced so as to avoid leaving any gaps between the beams. Such a solution is presently in use for multimedia satellites and it is complex since it requires six to eight antennas (three or four for transmission and three or four for reception).

OBJECT AND SUMMARY OF THE INVENTION

The present invention seeks to remedy the complexity of the above-mentioned multibeam antennas by proposing an antenna that associates a main antenna element (for transmission and/or reception), i.e. at least one main reflector or lens, with a plurality of primary sources, each of which is allocated to one beam.

The invention thus relates to a multibeam antenna, e.g. for the Ku, Ka, or C bands, wherein:

the antenna includes optics having at least one main antenna element, i.e. at least one reflector (generally of conical section, i.e. ellipsoidal or hyperboloidal), or else a lens, together with a set of primary sources, each primary source being suitable for generating a said beam which is taken up by the optics that transmit it, or else suitable for receiving a said beam that is picked up by the optics of the antenna;

the main antenna element has an aperture of nominal diameter D (taken in a plane perpendicular to the axis of the antenna), such that:

$$D=70B\lambda/HPBW$$

λ designating the center wavelength of the frequency band of the beams, i.e. for an antenna operating in transmission or in reception, the center wavelength of the transmission band or the reception band, as appropriate, and for an antenna operating in transmission and in reception, the center wavelength of that one of the transmission and reception bands that presents the lowest frequencies (in general this is the band corresponding to the down link);

HPBW standing for the half-power beam width (expressed in degrees) of the beams coming from the main antenna element (reflector or lens); and B being a dimensionless number lying in the range 1.5 to 4; and the optics present a profile modified by a profile correction that gives them a distribution obeying a relationship suitable for enlarging the reflected beams in comparison with conventional optics comprising a parabolic main reflector (or lens) optionally together with at least one hyperbolic secondary reflector. The distribution is preferably circularly symmetrical. This enlargement may be obtained from a phase distribution relationship $\phi(\rho)$ that is, for example, optimized for an aperture amplitude distribution relationship $f(\rho)$ that is specified for obtaining a radiation pattern $E(\theta)$.

Even when the phase distribution is symmetrical, it should be observed that the correction to the profile of the optics (reflector or lens) is asymmetrical, given the geometry of the system. The article "Trends in multi-beam reflector antennas for space" by S. J. STIRLAND et al. discusses an approach by over-sizing a single aperture, but disregards it because of poor side lobe and beam scanning performance.

The enlargement of the aperture angle of the beams, by modifying the profile of the main antenna element (parabolic reflector or lens) and/or of a secondary reflector according to the invention, makes it possible to overcome the drawbacks put forward by STIRLAND et al. and obtain beams that are narrowly spaced apart while maintaining a high degree of overlap and a low level for the side lobes, which cannot be achieved with a main reflector that is parabolic (optionally associated with one or more conventional hyperbolic reflectors).

The aperture phase distribution relationship $\phi(\rho)$ may present constant phase values $\delta_n$ in N annular zones of the antenna (n being an integer lying in the range 0 to N−1).

Alternatively, the aperture phase distribution relationship $\phi(\rho)$ may present slopes $\beta_n$ of the phase $\delta_n$ that are constant in N annular zones of the antenna (n being an integer lying in the range 0 to N−1).

Another phase distribution $\phi(\rho)$ may be obtained by cubic interpolation over N+1 pairs of values $(\rho_i, \phi_i)$, e.g. that are equidistant in radius ρ, so as to generate first and second derivatives of $\phi(\rho)$ that do not vary in discontinuous manner ("cubic spline interpolation").

The aperture amplitude distribution relationship may present a conical analytic function of the form:

$$f(\rho) = (1-\alpha)\left(1-\left(\frac{\rho}{a}\right)^2\right)^{\gamma} + \alpha$$

ρ designating the distance from a current point P to the center O of the aperture of the main reflector (FIG. 2*c*);

α designating the amplitude attenuation factor of the antenna at its outer edge ("edge taper");

a designating the radius of the aperture of the main antenna element (reflector or lens) (a=D/2); and γ=1 or 2.

The number N of annular zones generally lies in the range 4 to 10. It should be observed that it is possible to perform calculations over a greater number of zones (e.g. up to 15, or even 20 or 30), but that this increases the complexity of the calculations without significantly improving the result.

More generally, the aperture amplitude distribution relationship presents amplitude with circular symmetry. The amplitude distribution relationship may also be imported from the GRASP software from the supplier TRICA (Copenhagen, Denmark), in the form of a table of numbers for each frequency with (M+1) pairs of values ($\rho_j$, $f_j$), $f_j=f(\rho_j)$ designating the complex aperture field for ($\rho=\rho_j$), and j varying over the range 0 to M.

The optics may comprise solely said main antenna element (reflector or lens). Under such circumstances, the parabolic profile of the antenna is modified by a surface correction Δz(x,y) that provides said broadening of the reflected beams.

The optics may also present at least one said secondary reflector for taking the beams transmitted by the primary sources and directing it to the main antenna element (reflector or lens), and/or for taking the beams received by the main antenna element (reflector or lens) and directing them towards the primary sources. Under such circumstances, the correction may be performed on the main antenna element (reflector or lens) or on the secondary reflector(s), or indeed it may be shared between the main antenna element (reflector or lens) and the secondary reflector(s).

When the main antenna element is a reflector array, the profile correction is a surface correction and/or a phase shift correction applied to phase shifter elements (phase shift lines) of the reflector array.

The invention also provides a method of calculating a profile correction for an antenna as defined above, wherein the distribution function E(θ) is optimized from an amplitude function f(ρ), which function is conical, for example, or numerical, to which a phase distribution criterion is applied in N annular zones or by interpolation over (N+1) points so as to obtain an optimum phase distribution ϕ(ρ), and calculating a surface correction Δz(x,y) from said optimized phase distribution ϕ(ρ).

BRIEF DESCRIPTION OF THE DRAWINGS

The invention can be better understood on reading the following description given by way of non-limiting example, and with reference to the drawings, in which:

FIGS. 2*a* and 2*b* show two ways of embodying an antenna of the invention, respectively with and without an auxiliary reflector, and FIG. 2*c*, in which the right-hand portion shows a reflector in face view and the left-hand portion shows the analytic distribution of amplitude for γ=2 and α=0.2, shows the parameters a, D, α, and ρ;

MORE DETAILED DESCRIPTION

Figure 1:
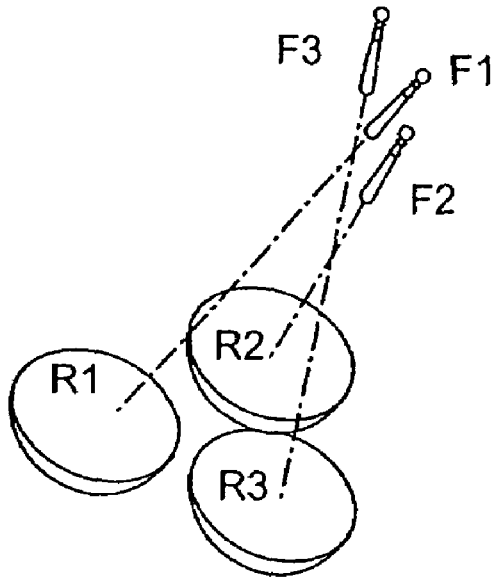
FIG. 1 shows an antenna having the third of the above-mentioned types of configuration.

In FIG. 1, a multi-beam antenna presents three parabolic reflectors $R_1$, $R_2$, and $R_3$ of aperture $D_0$ that are fed directly by primary sources $F_1$, $F_2$, and $F_3$ each presenting one radiating element per beam emitted by the respectively associated antenna $R_1$, $R_2$, and $R_3$.

Figure 2A:
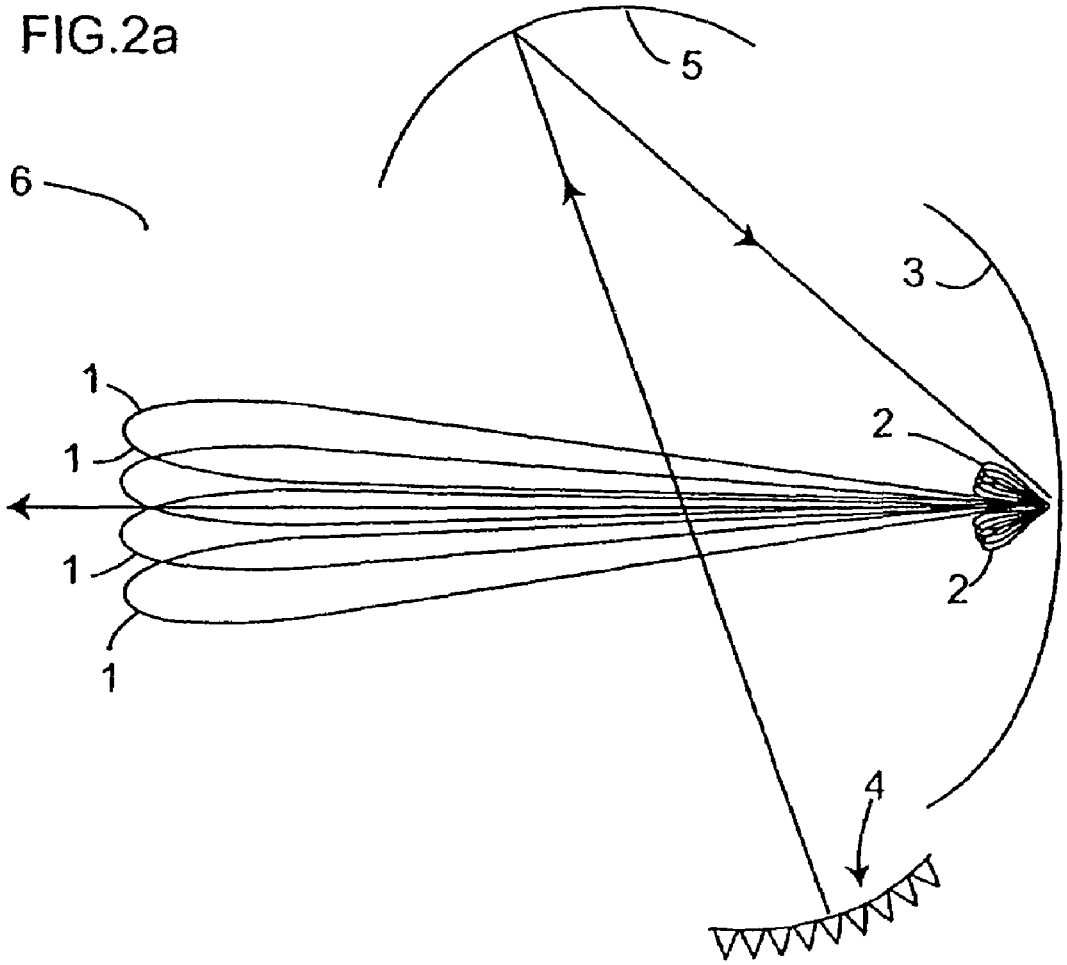

In FIG. 2*a*, the antenna presents an array 4 of individual primary sources, one per main beam 1, a secondary reflector 5, e.g. a hyperbolic reflector that picks up the signals transmitted by the individual primary sources and reflects them towards the main reflector 3 for transmitting the main beams 1 having side lobes 2 of low amplitude. Alternatively, it is possible to omit the secondary reflector 5 (see FIG. 2*b*).

In FIG. 2*b*, A is the vertex of the parabola as positioned prior to profile correction Δz (i.e. Δz=0), i.e. having a phase distribution ϕ(ρ)=0. In order to avoid the array of primary sources blocking the transmitted or received radiation, it is usual to offset the main reflector 3 by offsetting the center of the reflector relative to the vertex A of the parabola. The point F is the focus of the parabola (prior to correction), it being understood that once profile correction has been applied to the parabola, there no longer is a focus, strictly speaking. The center of the array of primary sources is placed at the point F.

The line AF constitutes the axis of the reflector, and the point O is the center of the aperture of the reflector 3.

The angle ψ(x,y) is the angle between the axis of the reflector AF and the straight line segment drawn between the point F and the current point P(x,y).

The aperture D (D=2*a*) of the main antenna element (reflector or lens) 3 is greater by a factor lying in the range 1.5 to 4 and more particularly in the range 1.7 to 3 than the aperture $D_0$ of the parabolic antenna elements of the third of the above-mentioned modes (e.g. FIG. 1) for beams transmitted (or received) in the same band.

The main antenna element (reflector or lens) 3 presents a profile that is initially parabolic, but that is subsequently corrected so that the main aperture of the antenna transmits beams that are close together with a high degree of overlap and with side lobes that are at low level. This is obtained by an optimization relationship that enlarges the beams so as to obtain beams that are narrowly spaced with a high degree of overlap, while conserving a low level for the side lobes. This correction may be applied to the profile of the reflector(s) 5 or it may be shared between the main antenna element (reflector or lens) 3 and the reflector(s) 5. The primary sources may be arranged to form a cluster such as 4, or else they may be separate. Similarly, they may be oriented in such a manner as to direct their beams directly towards the main antenna element (reflector or lens) 3, thus making it possible to make do without the reflector(s) 5 (FIG. 2*b*).

Most of the description below relates to circumstances in which the aperture of the antenna is essentially circular and generated by a main reflector of surface that is profiled in optimum manner.

It is also possible to use an aperture that is elliptical or of some other shape. It is also possible to replace the single main reflector by a lens or by reflectors constituting a reflector array having the same aperture dimensions and of surface that can be optimized to obtain the same illumination relationship in amplitude and phase as with the profiled reflector.

An advantage of lenses is that, because they operate in transmission without blocking any sources, it is possible to use a lens that is symmetrical and that is fed centrally. The performance of such a lens is better for beams remote form the axis of the system than in a reflector system in which the feed is offset.

Methods of shaping lenses to obtain a certain output relationship from a given input relationship are well known to specialists.

The principle of a reflector array (generally plane, which is an advantage), is described by way of example in the article "A shaped-beam microstrip patch reflectarray" by D. M. Pozar et al. in the journal IEEE Transactions on Antennas & Propagation, July 1999, pp. 1167-1173. Elements disposed in an array above or on a plane reflector (or constituted by plane panels) receive and reflect the incident energy. The distribution relationship for the energy reflected over the aperture can be controlled by adjusting the dimensions and/or the phase shift line of each element. It is thus possible to achieve the same outlet relationship merely by optimizing the profile of a single reflector or of a lens.

The relationship for amplitude and phase illumination of the main aperture 1 are obtained from the characteristics desired for the beams (number, HPBW transmission angle, spacing, level of side lobes) using synthesis tools known to the person skilled in the art. The application of these illumination relationships to the main aperture for each of the beams is obtained by conventional tools for designing primary source systems for optimizing the positions of the primary sources, their orientations, and the excitation relationship when there is a cluster of primary sources.

The radiation pattern on transmission E(θ) of the main aperture 3 is determined using the following formula:

$$E(\theta) = -jk\frac{e^{-jkR}}{R}\int_0^a Cf(\rho)e^{\gamma\Phi(\rho)}Jo(k\rho\sin\theta)\rho d\rho$$

ρ designating the distance between a current point P and the center O of the aperture of the reflector 3 (FIG. 2*c*);

k designating the free space wave number, with $k=2\pi/\lambda$; and

R designating the distance of the antenna (phase reference point) from the far field observation point; and in which the normalization factor C is defined by:

$$C = \sqrt{\frac{2}{\int_0^a f|(\rho)|^2\rho d\rho}}$$

A circularly symmetrical aperture amplitude distribution f(ρ) may be:

one or more analytic distributions having the form:

$$(1-\alpha)\left(1-\left(\frac{\rho}{a}\right)^2\right)+\alpha,$$

-continued i.e.

$$\gamma = 1$$

or of the form:

$$(1-\alpha)\left(1-\left(\frac{\rho}{a}\right)^2\right)^2+\alpha,$$

i.e.

$$\gamma = 2$$

(in FIG. 2*c*, the distribution corresponds to γ=2 and α=0.2);

or else a distribution presenting amplitude symmetry that is imported in the form of a table of numbers having (M+1) pairs of values $(\rho_j, f_j)$ where $f_j=f(\rho_j)$, and that is imported from the GRASP software from the supplier TICRA (Copenhagen, Denmark), for example. The intermediate values f(ρ) are determined by interpolation. The amplitudes $f_j$ are expressed in the form of complex values to include additional phase terms, j being an integer lying in the range 0 to M.

With a broad-band multifrequency design, or an antenna that can be used both for transmission and reception, a plurality of distribution $(\rho_j, f_j)$ can be introduced for a plurality of frequencies.

In order to determine the profile of the main reflector (or lens) that replaces a plurality of smaller-diameter parabolas, a phase distribution function φ(ρ) is calculated.

By way of example, a circularly symmetrical phase distribution function may be as follows:

a) constant phases $\delta_n$ in N successive annular zones of the antenna of radius ρ ($\rho_n<\rho<\rho_{n+1}$) for the $n^{th}$ zone, n lying in the range 0 to N−1, with:

$\rho_0=0$; $\rho_N=a$, where a is the half-aperture of the antenna, i.e. its nominal radius perpendicular to its axis;

b) constant phase slopes $\beta_n$ with $\beta_n=\Delta\delta_n/\Delta\rho_n$, in N annular zones of the antenna such that, for Δ designating difference, the following phase function:

$$\Phi(\rho) = \beta_n(\rho-\rho_n)+\sum_{i=0}^{n-1}\beta_i(\rho_{i+1}-\rho_i)$$

is continuous;

c) cubic interpolation over N+1 points $(\rho_i, \phi_i)$ equidistant in radius ρ so as to generate first and second derivatives of φ(ρ) that do not vary discontinuously.

These phase distributions are defined by tables comprising either N pairs of values $(\rho_i, \delta_i)$ or $(\rho_i, \beta_i)$, i varying from 1 to N, or N+1 pairs of values $(\rho_i, \phi_i)$, i varying from 0 to N.

In general, N is selected to lie in the range 4 to 10, but more generally it could lie in the range 4 to 30, or indeed 4 to 20. Greater values for N (e.g. 40 or 50) could be used, but at the cost of increasing the complexity of calculation without any practical advantage.

Other known methods of interpolation could also be implemented.

The optimization may be performed for example by using the "amoeba" algorithm of the "Downhill simplex method"

type by Nelder and Mead, as described for example on pp. 402 to 406 of the work by W. H. Press et al. entitled "Numerical recipes in FORTRAN, the art of scientific computing", Cambridge University Press, 2nd edition, 1992.

The amplitude distribution is selected in advance and is conserved, while the phase distribution is modified by the optimization algorithm.

For example, consideration can be given to a conical amplitude distribution having the form:

$$f(\rho) = (1-\alpha)\left(1-\left(\frac{\rho}{a}\right)^2\right)^2 + \alpha$$

$$(\gamma = 2)$$

to which a constant phase distribution criterion is applied in N annular zones, and E(θ) is optimized using said "amoeba" algorithm by specifying directivity in the region of the aperture and by specifying a level for the side lobes in the region of the side lobes, thus making it possible to determine the optimized values for the constant phases $\delta_n$.

With constant phase slopes $\beta_n$, the values of these phase slopes may also be optimized using said "amoeba" algorithm.

Once the optimum phase distribution $\phi(\rho)$ has been determined, the surface correction Δz to be applied to the main reflector in order to obtain the corresponding path length differences are calculated, giving:

$$\Delta z(x, y) = \frac{\phi(\rho)}{k[1+\cos\psi(x, y)]}$$

where $k=2\pi/\lambda$.

When there is a secondary reflector (FIG. 2*a*), the value of the correction Δz remains the same and it is calculated as in the above example, i.e. ignoring the secondary reflector 5.

Figure 3A:
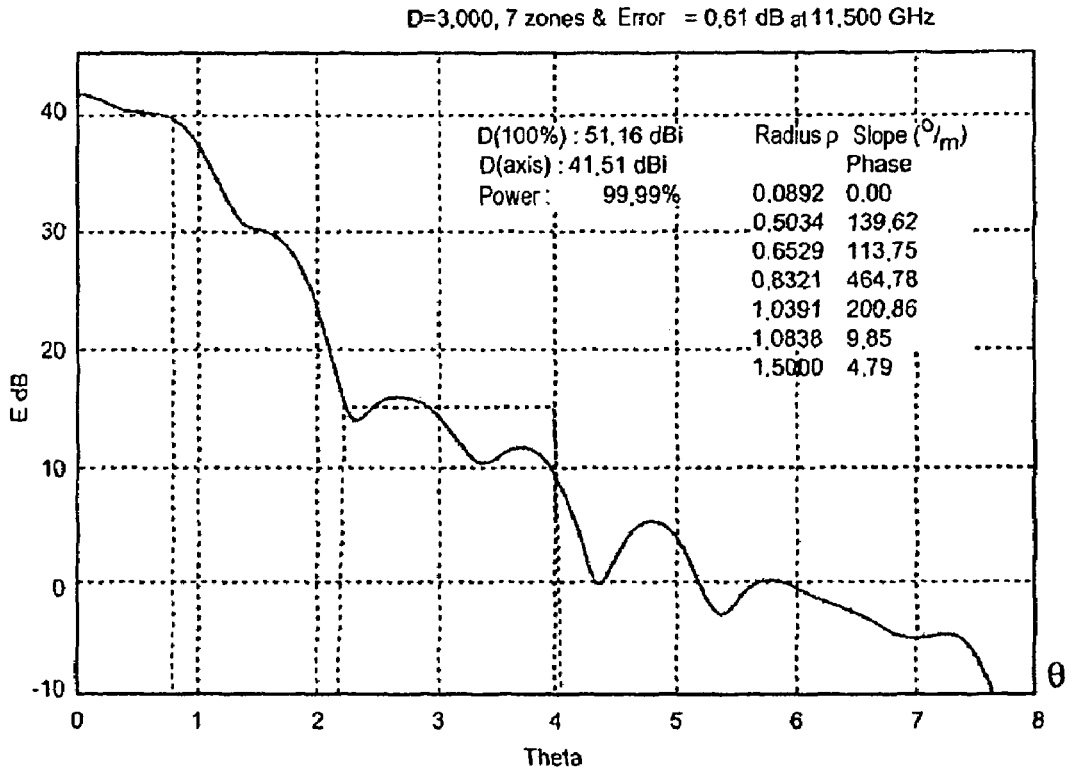
FIGS. 3*a* and 3*b* show an example of transmission distribution (or radiation patterns) E(θ) and of surface corrections Δz(x,y) for a circular aperture with D=3 meters (m) and N=7, for the embodiment of FIGS. 2*a* or of FIG. 2*b;*

FIG. 3*a* shows the optimized distribution E(θ) expressed in decibels obtained for a distribution $f(\rho)=(1-\alpha)(1-(\rho/\alpha)^2)^2+\alpha$ for D=3 m and N=7 zones, with phase distribution optimized for a level of illumination at the edge of the reflector equal to −22 dB. The main reflector is oriented along the y axis. Directivity is greater than 40 dBi for 0<θ<0.8°, and is above 15 dBi for 2.2°<θ<4° (with precision of 0.6 dB), such that the minimum directivity in the coverage zone is about 39.4 dBi and the maximum level of a side lobe is about 15.6 dBi, i.e. giving isolation of about 23.8 dB between the main lobe and the side lobe. The last column of the table gives the phase slope in degrees per meter (°/m).

Figure 3B:
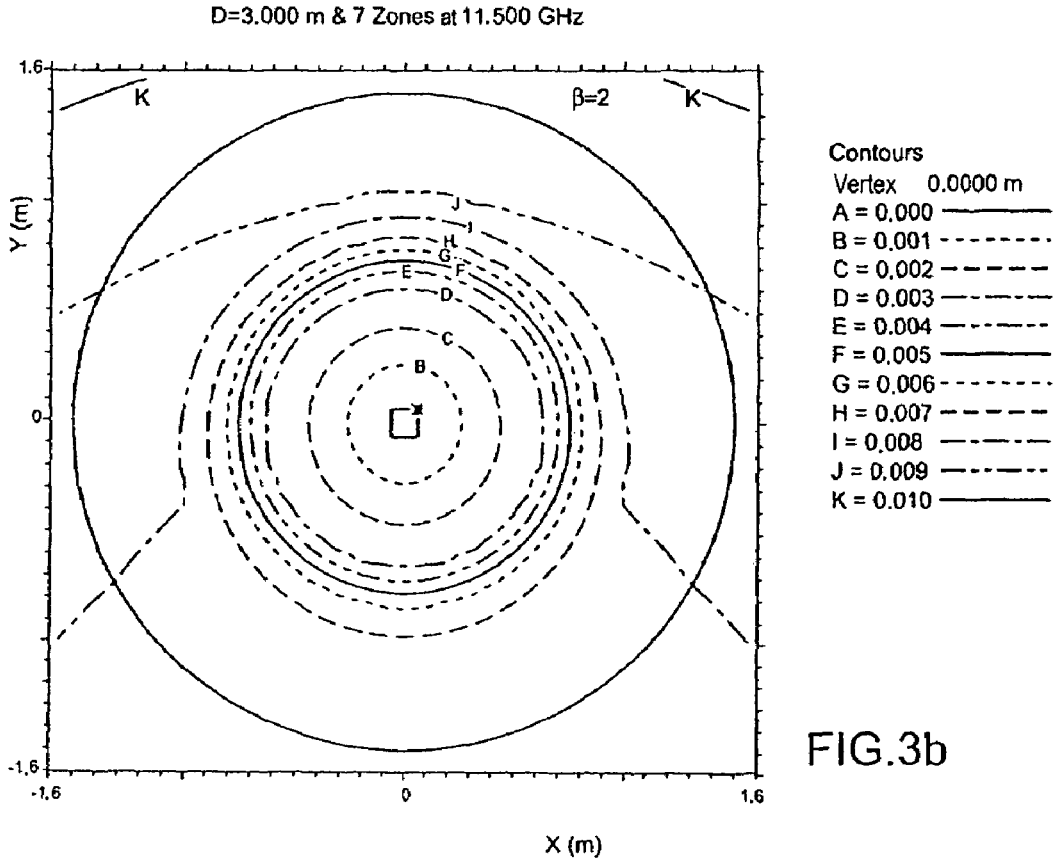

FIG. 3*b* shows the correction to be applied to the main parabolic reflector in the form of curves of correction levels A to J at intervals spaced apart stepwise by 1 mm (D=3 m and N=7 zones). This solution is suitable in particular for hybrid antennas operating in the Ku/Ka bands with HPBW beam width of about 1° and about thirty beams.

Figure 4A:
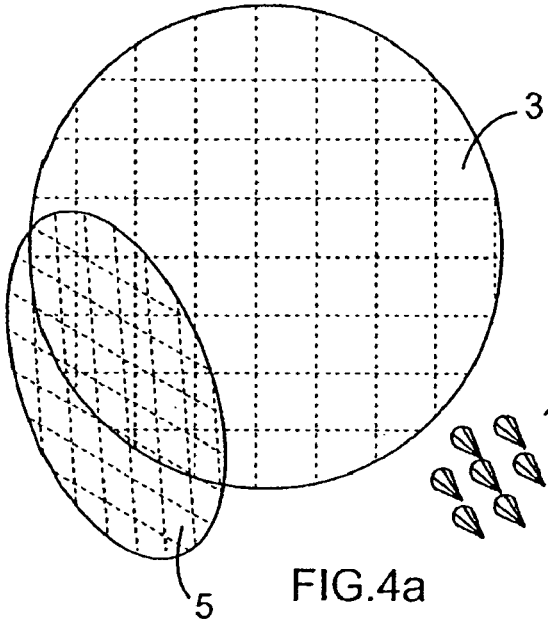
FIGS. 4*a* and 4*b* show two embodiments of the invention in the form of a Cassegrain type structure having an offset focus, with FIG. 4*c* showing the parameters f, D, $\phi_0$, and $\psi_0$.
Figure 4B:
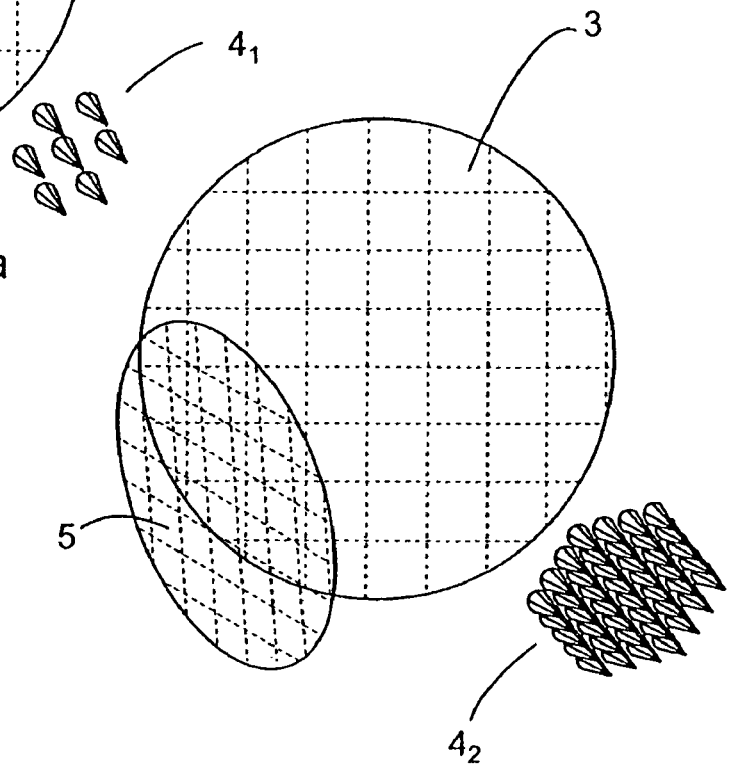
Figure 4C:
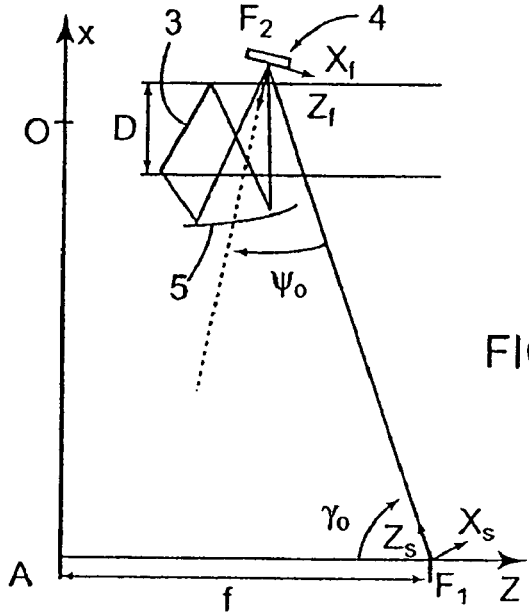

FIGS. 4*a* and 4*b* show two embodiments of the invention in the form of a Cassegrain type structure with an offset focus and with lateral feed (FIG. 4*c*) using respective clusters of primary sources $\mathbf{4}_1$ and $\mathbf{4}_2$. This configuration is itself known from the article by Rolf Jorgensen, Peter Balling, and William English entitled "Dual offset reflector multibeam antenna for international communications satellite applications", published in IEEE Transactions on Antennas and Propagation, Vol. AP-33, No. 12, December 1985, pp. 1304-1312, and more particularly with reference to its FIG. 3b on page 1306 (side-fed offset Cassegrain). This type of solution is particularly suitable for HPBW beam widths of about 0.5° with the number of beams being about 100 or more for regional coverage over the United States or over several European States.

These two examples differ in the number of primary sources which, in FIG. 4*b* are organized as a two-dimensional cluster $\mathbf{4}_2$ of touching primary sources.

This configuration has the advantage of a high f/D ratio for the main reflector (where f is its focal length), which in this example is equal to 4.29. The auxiliary reflector uses the concave portion of a hyperboloid (approximately of 0.383). The diameter of the cluster of primary sources is about 190 mm.

Figure 5A:
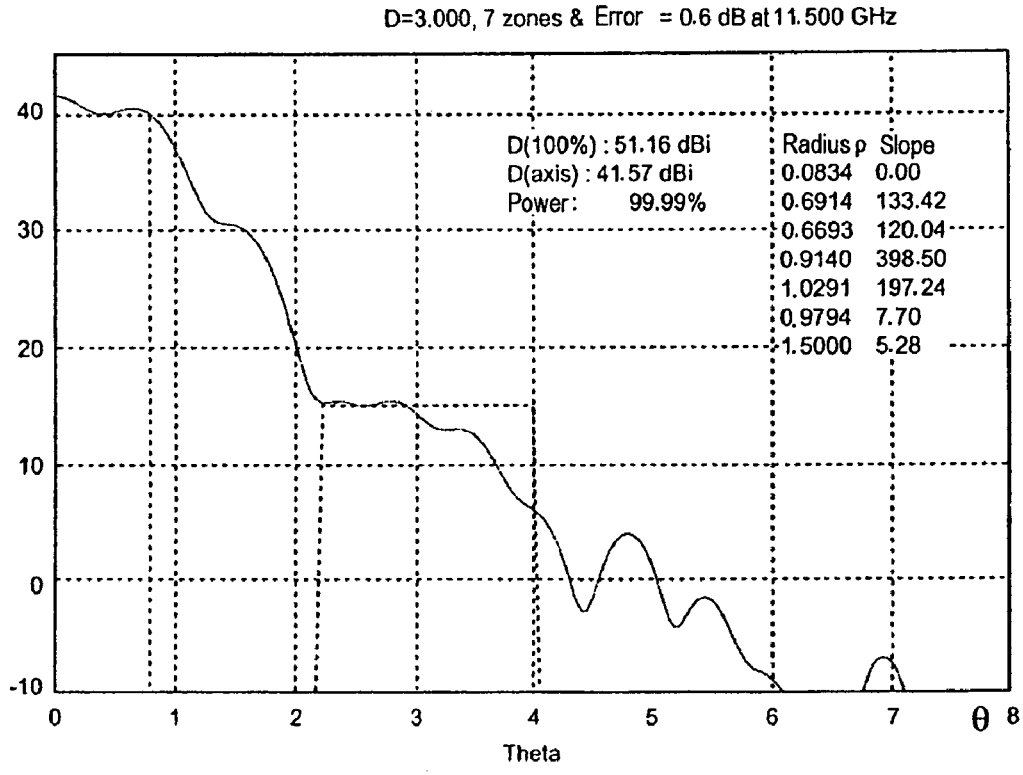
FIGS. 5*a* and 5*b* show an example of transmission distribution (or radiation pattern) E(θ) and of correction of the main reflector profile with D=3 m and N=7, for the embodiment of FIG. 4*a* or of FIG. 4*b*.
Figure 5B:
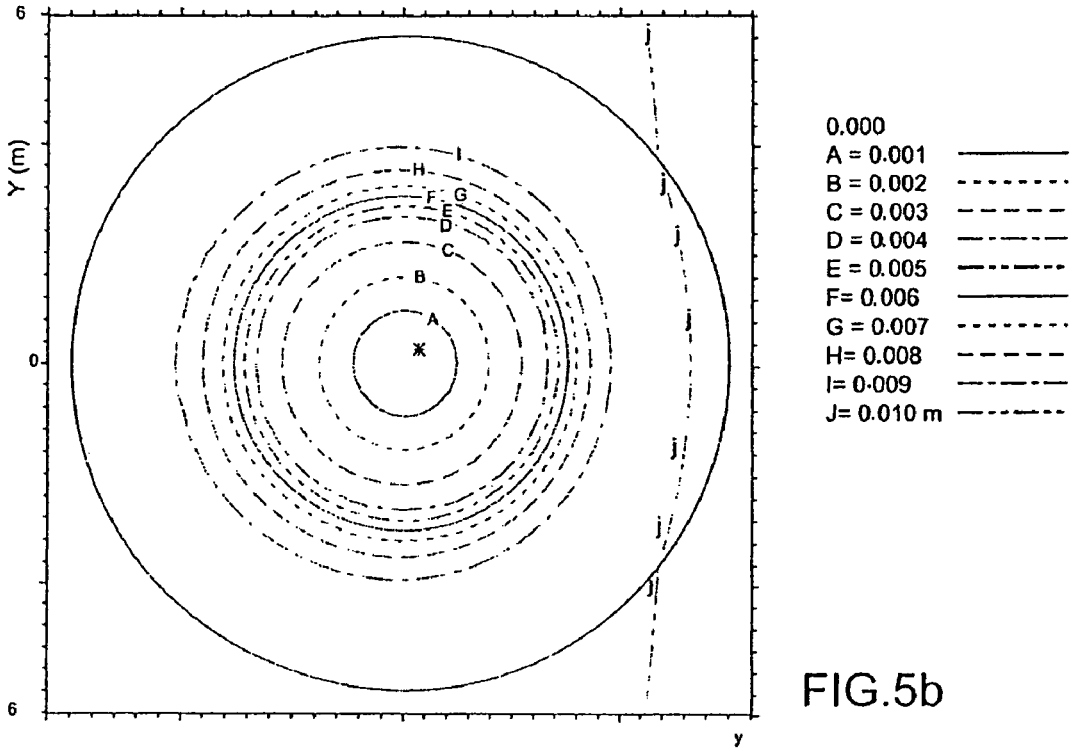

FIG. 5*a* shows the function E(θ) for D=3 m and N=7 zones with phase distribution optimized for an illumination area at the edge of the reflector of −22 dB. In this configuration, the main reflector 3 is oriented along the x axis (see FIG. 4*c*), and FIG. 5*b* shows the profile of the reflector presenting Δz corrections in the $(x_f, y_f, z_f)$ frame of reference associated with the reflector, presenting correction level curves A to I spaced apart by a step size of 1 mm.

Directivity remains greater than 40 dBi for 0<θ<0.8°, and is less than 15 dBi for 2.2°<θ<4°, with precision of 0.06 dB such that the minimum directivity in the coverage angle is greater than 40 dBi and the maximum level of the side lobe is 15 dBi, giving isolation of at least 25 dBi between the main lobe and the maximum level of a side lobe.

Given that the surface correction of the reflector is always relatively small (it remains typically less than λ/3), the passband is limited by the primary sources only. By way of example, the available frequency bands are 29.5 GHz–30 GHz (up link) and 19.7 GHz–20.2 GHz (down link), but also for example 27.5 GHz–30 GHz (up link) and 17.7 GHz–20.2 GHz (down link).

It should be observed that the invention can also be implemented with a different Cassegrain configuration, for example the so-called front fed offset Cassegrain (FFOC) as shown in FIG. 3a on page 1306 of the above-cite article by Rolf Jorgensen, Peter Balling, and William English.

What is claimed is:

1. An antenna for transmitting and/or receiving multiple beams, wherein:

the antenna includes optics comprising a main antenna element having at least one reflector or lens and optionally a secondary antenna element comprising at least one reflector or lens, together with a set of primary sources, each primary source transmitting or receiving one of said beams via the optics of the antenna;

the main antenna element has an aperture of nominal diameter D, such that:

$$D=70B\lambda/HPBW$$

λ designating the center wavelength of the frequency band of the beams;

HPBW standing for half-power beam width (expressed in degrees) of the beams coming from the main antenna element; and B being a dimensionless number lying in the range 1.5 to 4; and the optics present a profile modified by a profile correction giving it a distribution obeying a relationship suitable for enlarging the reflected beam relative to optics comprising a parabolic main reflector.

2. An antenna according to claim 1, wherein the profile correction corresponds to an aperture phase distribution relationship $\phi(\rho)$.

3. An antenna according to claim 2, wherein the aperture phase distribution relationship $\phi(\rho)$ corresponds to a cubic interpolation over (N+1) pairs of values $(\rho_i, \phi_i)$ so as to generate first and second derivatives of $\phi(\rho)$ that do not vary discontinuously.

4. An antenna according to claim 3, wherein N lies in the range 4 to 30, and more particularly in the range 4 to 20.

5. An antenna according to claim 2, wherein the aperture phase distribution relationship $\phi(\rho)$ corresponds to constant phase values $\delta_n$ in N adjacent and successive annular zones of the antenna (n being an integer lying in the range 0 to N−1).

6. An antenna according to claim 2, wherein the aperture phase distribution relationship $\phi(\rho)$ corresponds to slopes $\beta_n$ of the phase $\delta_n$ that are constant in N adjacent and successive annular zones of the antenna (n being an integer lying in the range 0 to N−1).

7. An antenna according to claim 1, presenting an aperture amplitude distribution relationship having amplitude of circular symmetry.

8. An antenna according to claim 1, presenting an aperture amplitude distribution relationship having an analytic function of the form:

$$f(\rho) = (1-\alpha)\left(1-\left(\frac{\rho}{a}\right)^2\right)^{\gamma} + \alpha$$

$\rho$ designating the distance of a current point P to the center O of the aperture of the main antenna element;

$\alpha$ designating the amplitude loss factor of the antenna at its outer edge;

a designating the radius of the aperture; and $\gamma$=1 or 2.

9. An antenna according to claim 1, presenting an imported aperture amplitude distribution relationship $f(\rho)$ in the form, for at least one frequency, of a numerical table having M+1 pairs of values $(\rho_j, f_j)$, $f_j=f(\rho_j)$ designating the complex aperture field for $\rho=\rho_j$, and j varying from 0 to M.

10. An antenna according to claim 9, wherein the optics are of the Cassegrain type having an offset focus (FFOC, SFOC).

11. An antenna according to claim 1, wherein the main antenna element presents said profile correction.

12. An antenna according to claim 1, wherein the optics also present at least one said secondary antenna element for receiving the beams emitted by the primary sources and delivering them towards the main antenna element, and/or for taking the beams received by said main antenna element and directing them towards the primary sources.

13. An antenna according to claim 1, wherein the optics present solely said main antenna element.

14. An antenna according to claim 1, wherein the main antenna element is a single lens or a reflector, and wherein said profile correction is a surface correction.

15. An antenna according to claim 1, wherein the main antenna element is a reflector array, and wherein said profile correction is a surface correction and/or a phase shift correction applied to phase shifter elements of the reflector array.

16. An antenna according to claim 1, wherein said distribution is circularly symmetrical.

17. A method of calculating a profile correction for an antenna according to claim 1, the method optimizing the radiation pattern $E(\theta)$ from an amplitude function $f(\rho)$ to which a phase distribution criterion is applied in N annular zones, or by interpolation over N+1 points so as to obtain an optimum phase distribution $\phi(\rho)$, and calculating a surface correction $(\Delta z)$ from said optimum phase distribution $\phi(\rho)$.

* * * * *